US006814618B2

(12) United States Patent
Ishikawa et al.

(10) Patent No.: US 6,814,618 B2
(45) Date of Patent: Nov. 9, 2004

(54) CONNECTOR WITH RESILIENT COUPLING PIECES COUPLING LOCKS IN ADJACENT CAVITIES

(75) Inventors: Ryotaro Ishikawa, Yokkaichi (JP); Hajime Kawase, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/643,617

(22) Filed: Aug. 19, 2003

(65) Prior Publication Data

US 2004/0038595 A1 Feb. 26, 2004

(30) Foreign Application Priority Data

Aug. 20, 2002 (JP) ..... 2002-238848

(51) Int. Cl.[7] ..... H01R 13/40
(52) U.S. Cl. ..... 439/595; 439/682; 439/748
(58) Field of Search ..... 439/748, 595, 439/682, 752.5

(56) References Cited

U.S. PATENT DOCUMENTS

| | | | | |
|---|---|---|---|---|
| 4,565,416 A | * | 1/1986 | Rudy et al. | 439/748 |
| 4,820,198 A | | 4/1989 | Lulko et al. | |
| 5,316,504 A | | 5/1994 | Jinno | 439/595 |
| 5,733,144 A | | 3/1998 | Tsuji et al. | |
| 6,354,873 B1 | * | 3/2002 | Morello et al. | 439/595 |

FOREIGN PATENT DOCUMENTS

| | | |
|---|---|---|
| GB | 2 162 702 A | 2/1986 |
| JP | 6-325814 | 11/1994 |

* cited by examiner

*Primary Examiner*—Renee Luebke
(74) *Attorney, Agent, or Firm*—Gerald E. Hespos; Anthony J. Casella

(57) ABSTRACT

A connector has a housing (30) with side-by-side cavities (31). A resiliently deformable lock (40) is formed in each cavity (31) for locking terminal fittings (10) in the respective cavities (31). Locks (40) of adjacent cavities (31) are coupled by coupling pieces (51) to enhance the strength of the locks (40).

16 Claims, 9 Drawing Sheets

CONNECTOR WITH RESILIENT COUPLING PIECES COUPLING LOCKS IN ADJACENT CAVITIES

BACKGROUND OF THE INVENTION

1. Field of the Invention

The invention relates to a connector designed to improve a locking force of a lock.

2. Description of the Related Art

Japanese Unexamined Patent Publication No. 6-325814 discloses a connector with a housing that has side-by-side cavities for receiving terminal fittings. A resiliently deformable lock is formed on the ceiling or bottom surface of each cavity. The terminal fittings deform the respective locks as the terminal fittings are inserted into the corresponding cavities. However, each lock is restored when the terminal fitting is inserted a specified distance, and the restored lock secures the terminal fitting in the cavity.

Miniaturized connectors have become a pressing necessity in recent years. Accordingly, terminal fittings and cavities have been formed smaller, and locks have been made narrower. However, the locking force of a narrower lock often is deficient.

Thought has been given to thickening the locks to enhance rigidity. However, a thicker lock results in a taller housing, which is against a tendency to miniaturize the connector. Thus, a thicker lock cannot be adopted easily.

The invention was developed in view of the above problem and an object is to enhance a locking force of a lock while keeping a connector small.

SUMMARY OF THE INVENTION

The invention relates to a connector with a housing that has side-by-side cavities into which terminal fittings are insertable. A resiliently deformable lock is provided in each cavity for locking the corresponding terminal fitting so as not to come out. At least two adjacent or neighboring locks are coupled via at least one coupling piece.

A large pulling force on the terminal fitting conceivably could deform a lock sufficiently to withdraw the terminal fitting. However, the side surfaces of each pair of the adjacent locks of the subject connector are coupled by the coupling piece. The coupling piece resists deformation of the lock and enhances a locking force on the terminal fitting. Accordingly, the locks can be narrower and intervals between the cavities can be smaller. Furthermore, the coupling pieces take advantage of a dead space between the side surfaces of the locks. Thus, the housing can be shorter in accordance with the demand for a miniaturized connector.

The coupling piece preferably is formed over substantially the entire length of the lock.

The coupling piece preferably is near a guide groove in the receptacle that receives a stabilizer of the terminal fitting.

The lock preferably has a leading end for locking the terminal fitting and the coupling piece has a thickness that increases backward in a longitudinal direction away from the leading end.

Cut-away portions or windows preferably are provided in the housing in a position of lateral walls substantially corresponding to the coupling piece.

The lock preferably has a width substantially equal to or slightly smaller than the width of the cavity.

The terminal fitting preferably has a locking projection with which the lock can cooperate for locking the terminal fitting in the respective cavity. The lock may comprise an insertion groove for receiving the locking projection.

The bottom of the insertion groove preferably is sloped towards a position where the terminal fitting is to be positioned at the base end of the lock and is substantially parallel to an insertion direction of the terminal fitting into the cavity at the leading end of the lock.

The coupling piece preferably is sloped towards a position where the terminal fitting is to be positioned at the base end and is substantially parallel to an insertion direction of the terminal fitting into the cavity at the leading end of the lock, in a manner similarly to the insertion groove.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
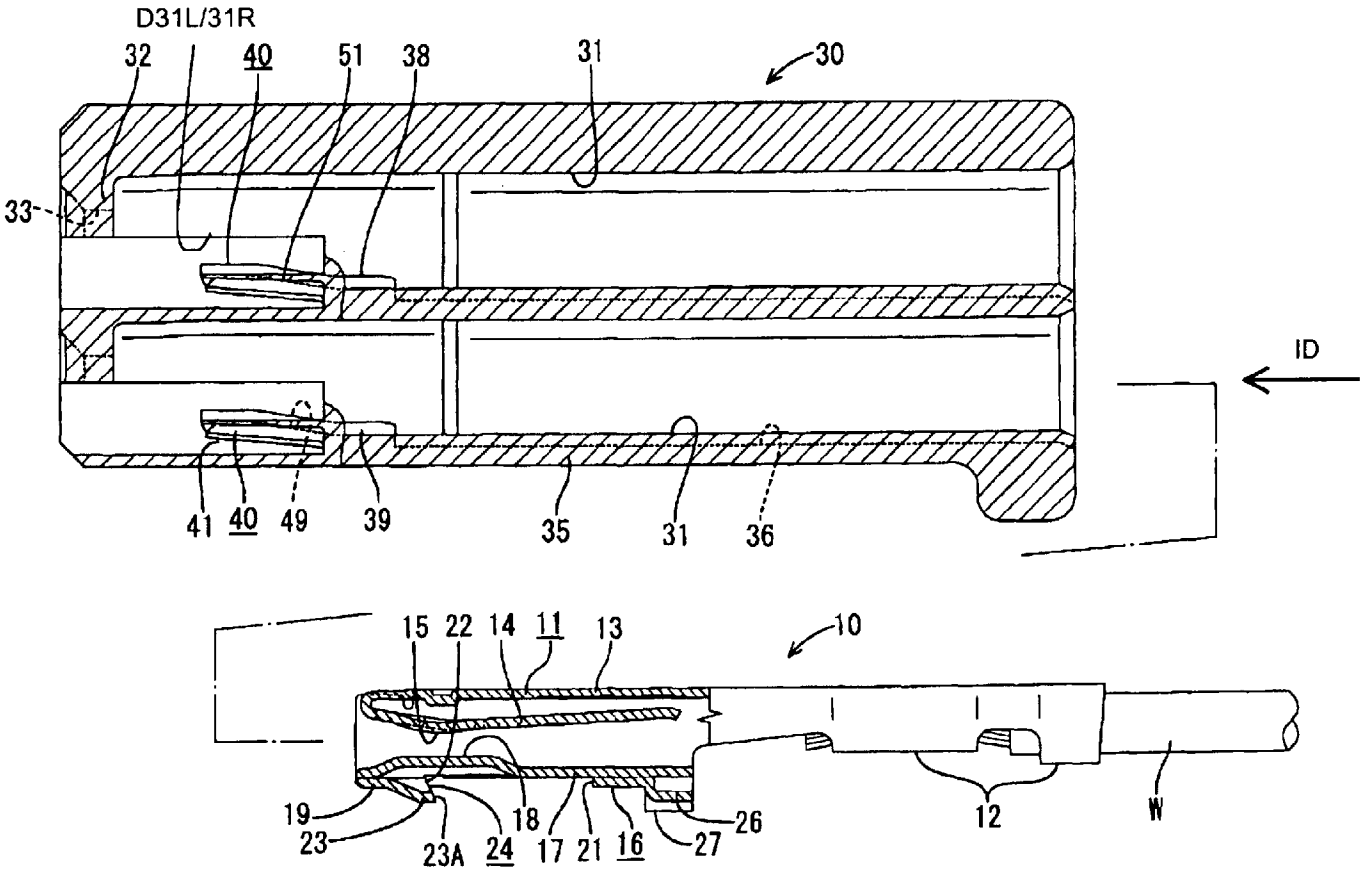
FIG. 1 is a side view in section showing a state before female terminal fittings are inserted into a female housing according to one embodiment of the invention.
Figure 2:
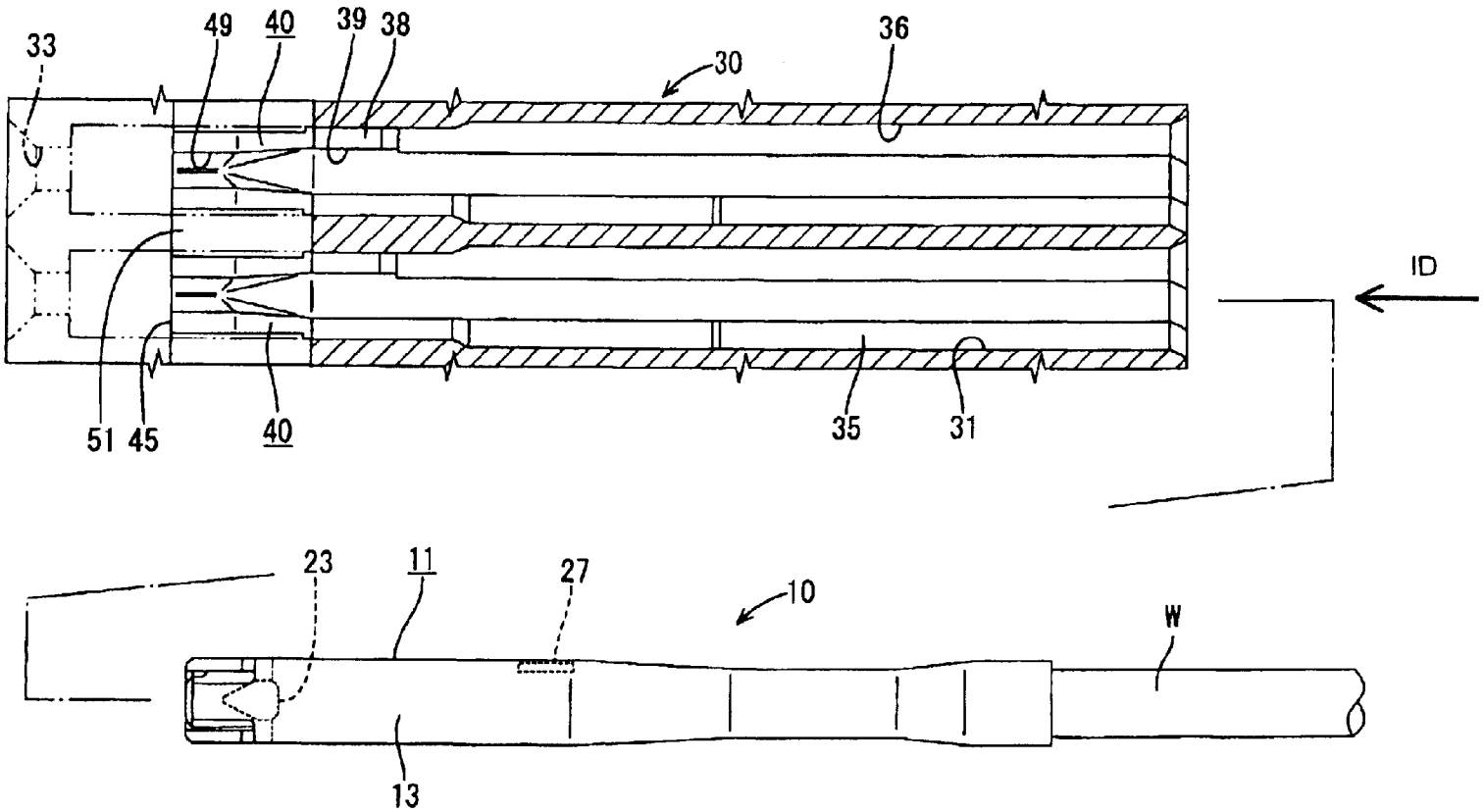
FIG. 2 is a plan view in section showing the state of FIG. 1.

A female connector in accordance with the invention includes female terminal fittings 10 and a female housing 30, as illustrated in FIGS. 1 to 9. The female housing 30 is formed with cavities 31 that are dimensioned and configured to receive the terminal fittings 10, as shown in FIGS. 1 and 2. A connecting side of the connector with a mating connector (left side e.g. in FIGS. 1, 2, 3 and 6 to 8) will be hereinafter referred to as the front.

Figure 3:
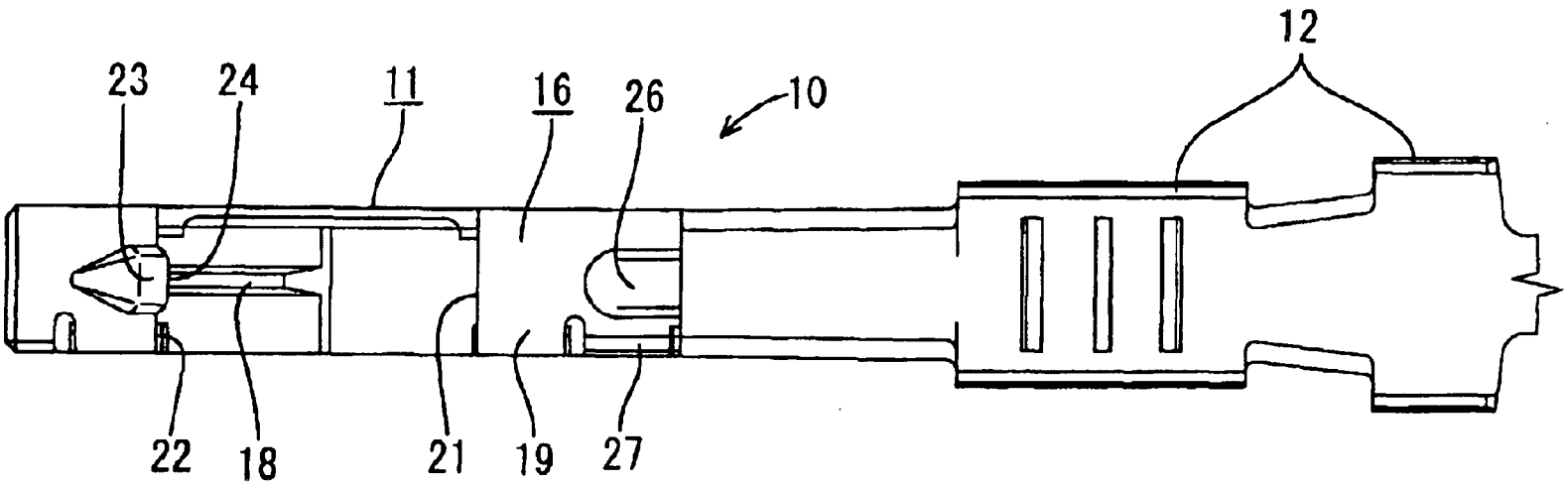
FIG. 3 is a plan view of the female terminal fitting.

The female terminal fitting 10 is formed into a shape shown in FIGS. 1 to 3 by working a conductive (metallic) plate having an excellent electrical conductivity preferably by a press. More particularly, the female terminal fitting 10 has a main body 11 substantially in the form of a rectangular tube with open front and rear ends. Barrels 12 are formed rearward of the main body 11 and can be crimped, bent or folded into connection with an end of a wire W. The female terminal fitting 10 is inserted or insertable into the cavity 31 while being turned upside down, as shown in FIG. 1.

The main body 11 has a bottom wall 13 and a tongue-shaped resilient contact piece 14 is folded back at a moderate angle from the front edge of the bottom wall 13 (upper side in FIG. 1). A contact 15 is defined at the front tip of the resilient contact piece 14 and can be brought into contact with a tab (not shown) of a mating male terminal fitting.

The main body 11 has a double-wall ceiling 16 (lower side in FIG. 1), and an inner panel 17 of the ceiling 16 includes a receiving portion 18 that bulges in at a position facing the contact 15 of the resilient contact piece 14. Thus, the receiving portion 18 presses the tab of the male terminal fitting.

The double-wall ceiling 16 also has an outer panel 19. The outer panel 19 is formed with a cut-away 21 over substantially the entire width in a substantially longitudinal middle portion, as shown in FIGS. 1 and 3. A front cut-end surface 22 of the cut-away 21 is embossed or cut and bent to form a locking projection 23 that projects out.

The locking projection 23 is an elongated projection having a gate-shaped cross section with an open rear surface, and a front part thereof is tapered so that the width and/or height gradually decrease toward the front end. A rear end surface 23A of the locking projection 23 and the cut-end surface 22 of the cut-away portion 21 are substantially continuous with each other, and define a locking surface 24. The locking surface 24 is overhanging or undercut so that the projecting end thereof is more backward than the base end thereof as shown in FIG. 1 (i.e. forms an acute angle with respect to the longitudinal direction while projecting backward).

An auxiliary locking projection 26 is formed at the rear edge of the outer panel 19 of the ceiling 16 to engage an unillustrated retainer for double locking, and a stabilizer 27 projects at one side of the auxiliary locking projection 26.

The female housing 30 is molded e.g. of a synthetic resin and has cavities 31 disposed side-by-side along a transverse direction TD at upper and lower stages. The female terminal fittings 10 are inserted into the cavities 31 from behind along an inserting direction ID.

A front wall 32 is formed in an upper area of the front surface of each cavity 31 and functions to stop the female terminal fitting 10 at a front-limit position. A terminal insertion opening 33 is formed in the front wall 32 to receive the tab of the mating male terminal fitting. A lower area of the front surface of each cavity 31 is open forward.

A guide groove 36 is formed at the left side of a bottom wall 35 of each cavity 31 when viewed from the front (see FIG. 2) and extends from the rear end of the cavity 31 to a position slightly before the longitudinal center. The guide groove 36 receives the stabilizer 27 of the female terminal fitting 10.

The bottom wall 35 of each cavity 31 has an elevated portion 38 at a position immediately before the guide groove 36, and a lock 40 for locking the female terminal fitting 10 is formed before the elevated portion 38.

Figure 5:
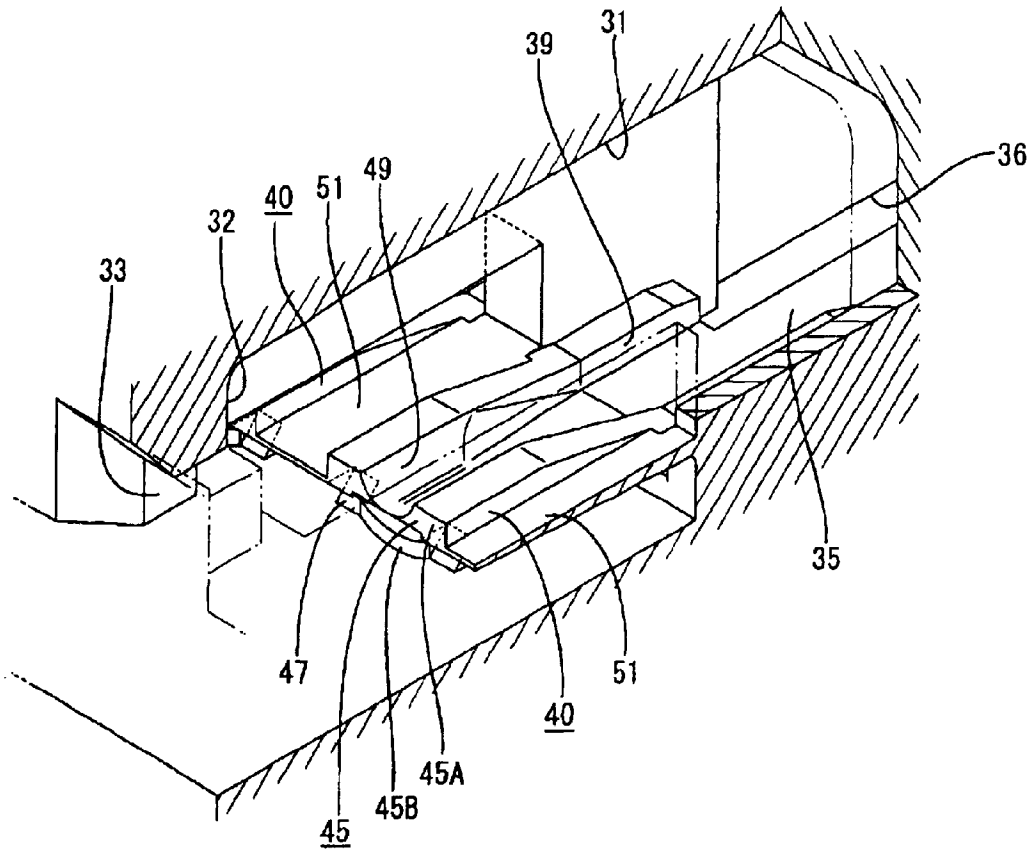
FIG. 5 is a perspective view showing a part where a lock is formed.

The lock 40, as shown in FIG. 5, is slightly narrower than the cavity 31, and a leading end of the lock 40 is resiliently deformable along a deflection direction DD substantially normal to the inserting direction ID and toward a deformation space 41 in the bottom surface of the cavity 31. A part of the cavity before the lock 40 is open to enable the removal of a mold.

The lower surface of the lock 40 is sloped moderately up from the base end toward the leading end. The upper surface of the lock 40 near the base end is sloped down at an inclination slightly steeper than that of the lower surface. However, the upper surface is substantially horizontal and parallel to the insertion direction ID at the leading end of the lock 40.

The lock 40 has a leading end surface 45 that is engageable with the locking surface 24 comprised of the rear end surface 23A of the locking projection 23 on the ceiling wall 16 of the female terminal fitting 10 and the cut-end surface 22 of the cut-away portion 21 when the female terminal fitting 10 is inserted into the cavity 31 by a proper distance.

Accordingly, the leading end surface 45 of the lock 40 has a shape substantially in conformity with the of the locking surface 24 and is comprised of an upper inwardly oriented contact surface 45A extending over substantially the entire width and engageable with the cut-end surface 22. A narrower lower outwardly oriented contact surface 45B is engageable with the rear end surface 23A of the locking projection 23. The contact surfaces 45A, 45B are substantially continuous one over the other as shown by dotting in FIG. 4. The lower surface of the lock 40 bulges arcuately at a position corresponding to the width of the lower contact surface 45B.

Jig catching recesses 47 for catching or cooperating with a disengagement jig are formed at the opposite sides of the lower contact surface 45B. The disengagement jig is caught to forcibly resiliently deform the lock 40, thereby canceling the locked state.

An insertion groove 49 is formed in a widthwise middle of the upper surface of the lock 40 to permit passage of the locking projection 23 of the female terminal fitting 10. The insertion groove 49 is continuous with an escape groove 39 in the elevated portion 38 of the bottom wall 35 of the cavity 31.

The bottom of the insertion groove 49 is sloped up towards a position where the terminal fitting 10 is to be positioned at the base end of the lock 40 and is substantially horizontal an parallel to the insertion direction ID at the leading end of the lock 40. Opposite side surfaces of the insertion groove 49 gradually bulge in at locations where the bottom is sloped up. Thus, the width of the insertion groove 49 is gradually narrower toward the leading end. The bottom of the insertion groove 49 is arcuate from side-to-side at the leading end where the insertion groove 49 is substantially horizontal.

A widthwise middle portion of the lower surface of the lock 40 opposite the insertion groove 49 bulges out arcuately to secure a sufficient thickness for the lock 40.

Figure 4:
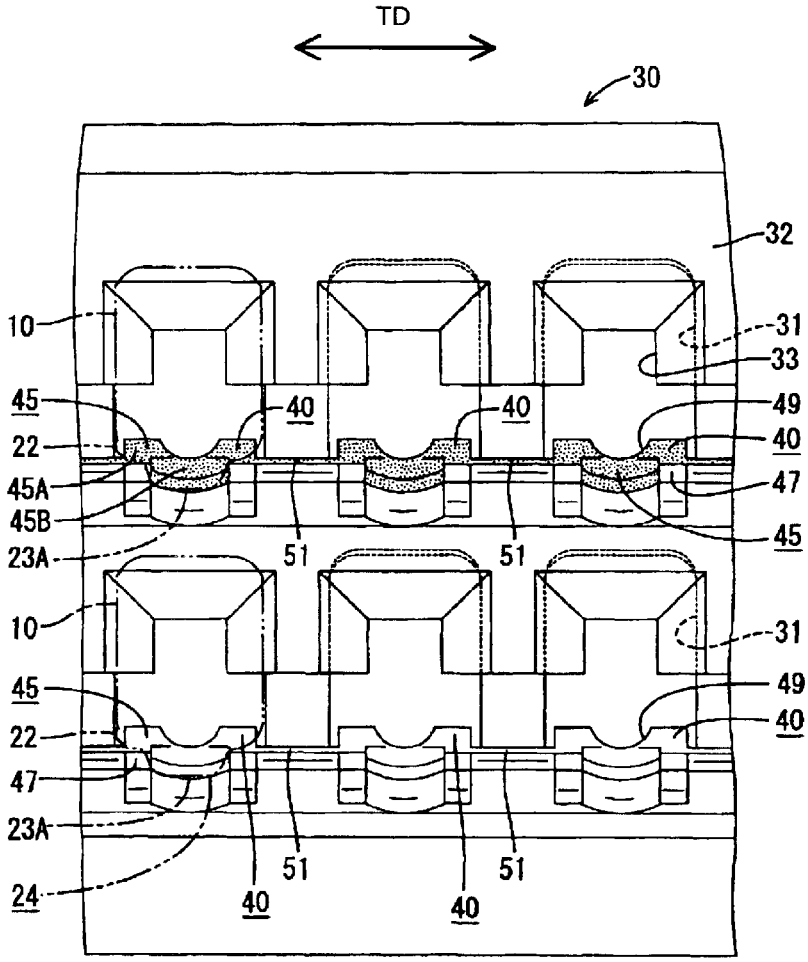
FIG. 4 is a partial front view of the female housing.
Figure 6:
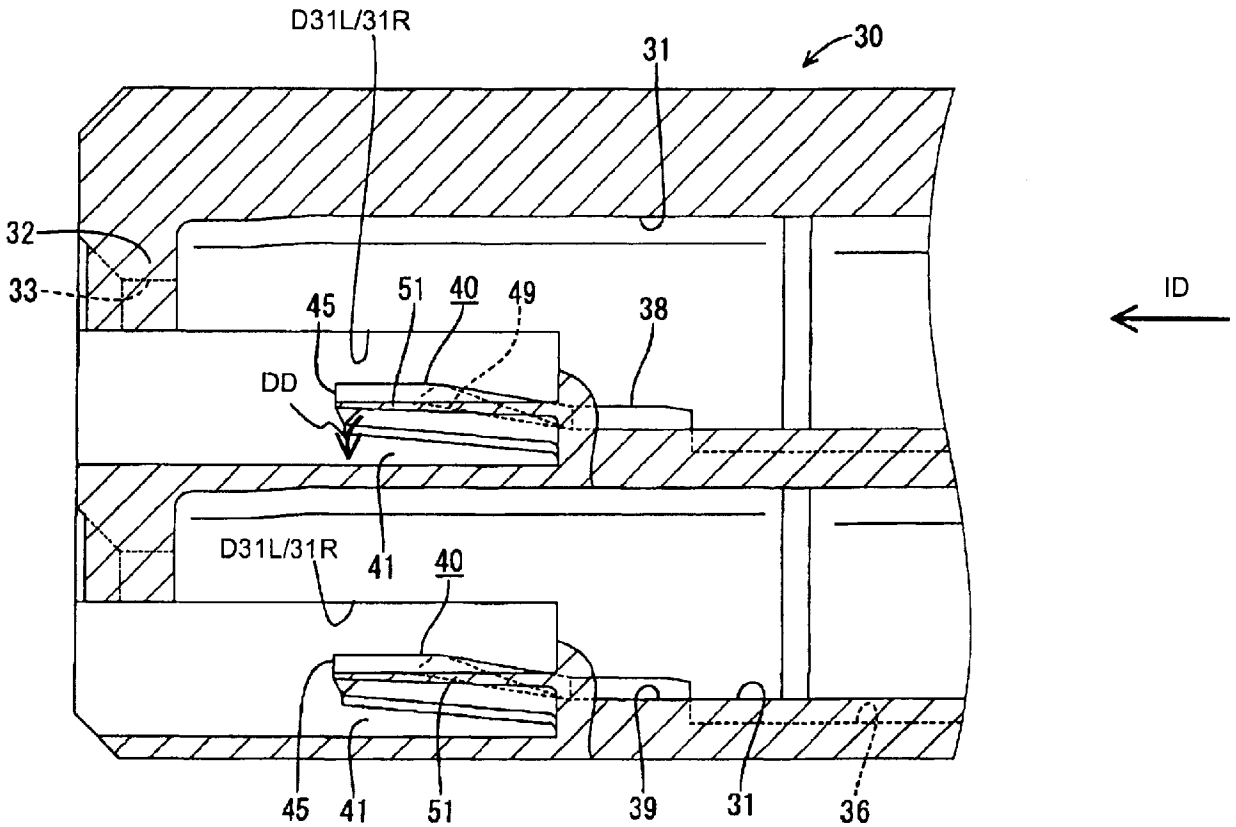
FIG. 6 is a partial enlarged side view in section of the female housing.

Side surfaces of the adjacent locks 40 in each of the upper and lower stages are coupled unitarily by thin coupling pieces 51, as shown in FIGS. 4 to 6. Each coupling piece 51 is formed at the leading end where the bottom of the insertion groove 49 is substantially horizontal and extends over substantially the entire length of the lock 40. Thus, each coupling piece 51 is in a position on the side surface of the lock 40 substantially corresponding to the bottom end of the lower contact surface 45A. Each coupling piece 51 has an upper surface that is substantially horizontal and parallel to the inserting direction ID and a lower surface that slopes down toward the back to facilitate mold removal. Thus, each coupling piece 51 becomes gradually thicker toward the back. The left and right side walls of the cavities 31 have cut-away portions 31L, 31R along a longitudinal length corresponding to the coupling pieces 51 and laterally adjacent locks 40 of adjacent cavities 31 to be coupled by the coupling pieces 51 through the cut-away portions 31L, 31R. The coupling pieces 51 are provided between adjacent locks 40 or may be provided with a portion of the lateral sidewall of the cavity 31 arranged therebetween. In other words, the coupling pieces 51 may directly couple adjacent locks 40 or may be coupled indirectly to adjacent locks 40 by partly arranging a portion of the lateral sidewall between two locks 40. Moreover, the coupling pieces 51 may be provided between part of the adjacent locks 40 and preferably between all pairs of adjacent locks 40.

Figure 7:
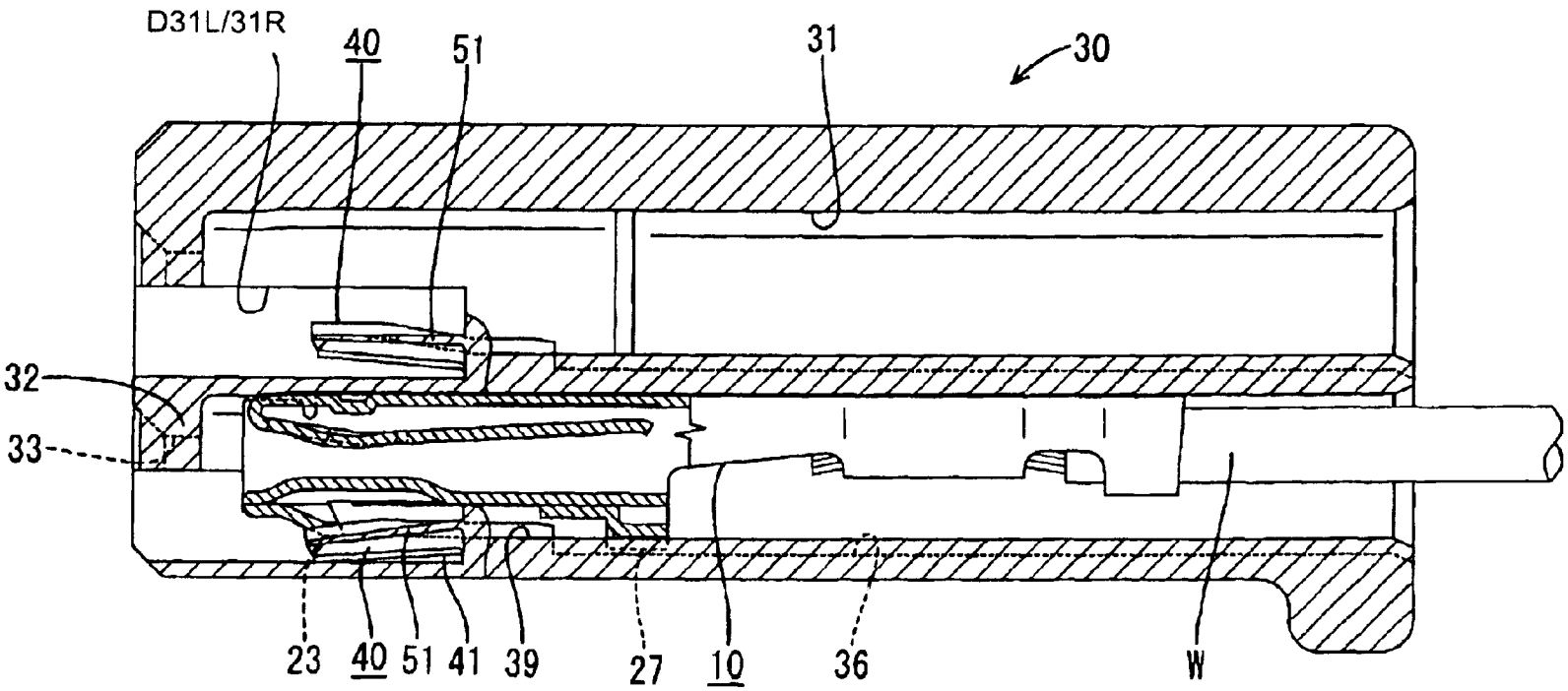
FIG. 7 is a side view in section showing an intermediate stage of insertion of the female terminal fitting.

As shown in FIGS. 1 and 2, the female terminal fitting 10 secured or securable to the end of the wire W is inserted into the corresponding cavity 31 in the inserting direction ID, preferably from behind, while being turned upside down with the locking projection 23 faced down. The female terminal fitting 10 is pushed straight in the inserting direction ID while passing the stabilizer 27 along the guide groove 36. At an intermediate stage of the insertion, the locking projection 23 of the female terminal fitting 10 passes the escape groove 39 in the elevated portion 38 and successively moves onto the insertion groove 49 formed in the upper surface of the lock 40. In this way, the female terminal fitting 10 the locking projection 23 pushes and deforms the lock 40 resiliently in the deformation direction DD toward the deformation space 41, as shown in FIG. 7.

Figure 8:
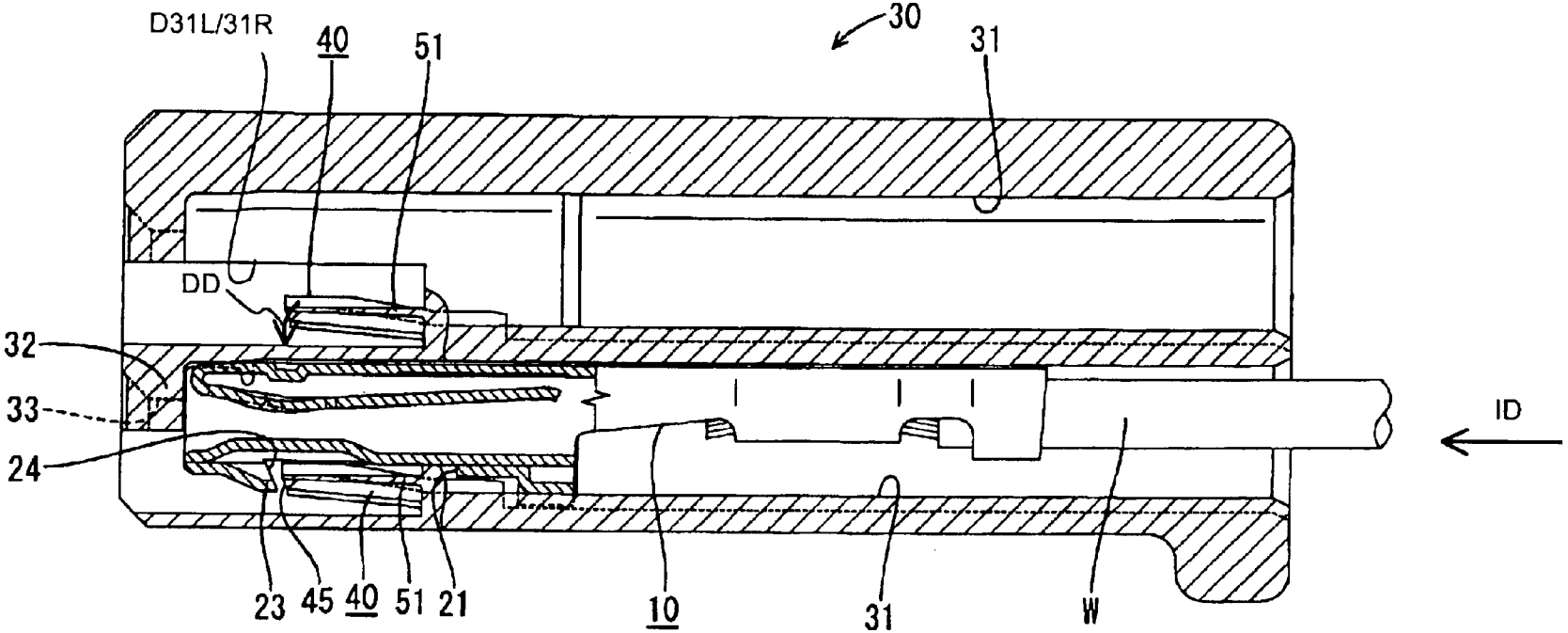
FIG. 8 is a side view in section when the insertion of the female terminal fitting is completed.
Figure 9:
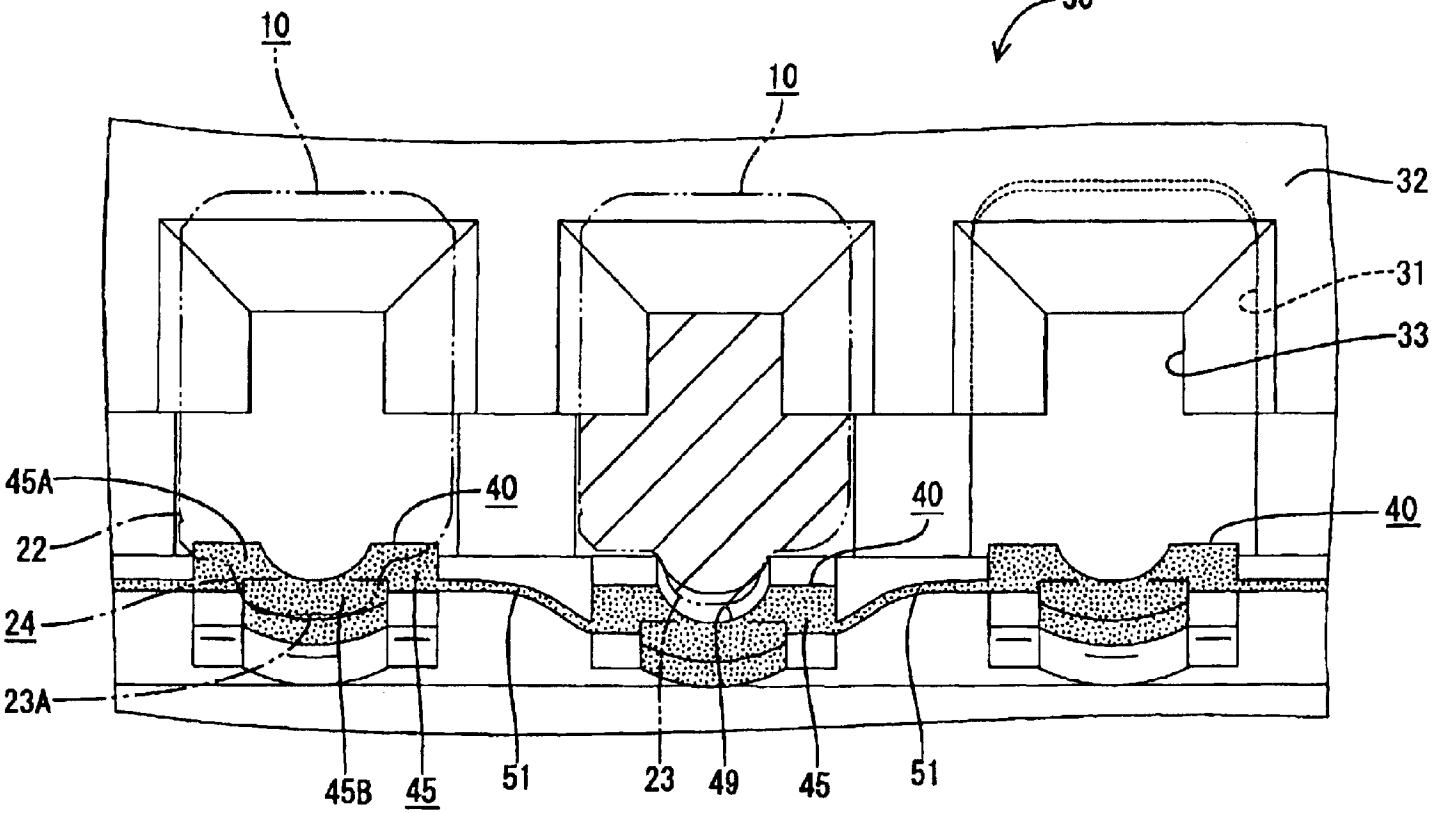
FIG. 9 is a partial front view of a female housing at an intermediate stage of insertion of one female terminal fitting.

The female terminal fitting 10 is inserted to a proper position and contacts the front wall 32. Simultaneously, the locking projection 23 moves over the lock 40. Thus, the lock 40 returns resiliently, as shown in FIG. 8, to enter the cut-away portion 21 and to engage the female terminal fitting 10.

Each lock 40 is coupled to one or two other locks 40 by the coupling pieces 51. Thus, a first lock 40 deforms in the deformation direction DD due to forces exerted during the insertion of a first female terminal fitting 10 and this deformation of the first lock 40 generates deflection of at least one other lock 40 in the deformation direction DD due to the coupling achieved the coupling pieces 51. Specifically, insertion of the female terminal fitting 10 into the middle cavity 31 of FIG. 9 resiliently deforms the lock 40 in the deformation direction DD. The locks 40 of the cavities 31 at the opposite sides also are deformed resiliently, so that the three cavities 31 including the two coupling pieces 51 form a substantially arcuate shape as a whole. However, the locks 40 at the opposite sides are deformed to a smaller degree than the middle lock 40. Thus, even if the female terminal fitting 40 is inserted already, as in the left cavity 31 of FIG. 9, at least a part of the leading surface 45 of the lock 40 remains engaged with the locking surface 24 of the female terminal fitting 10. Thus, the inserted female terminal fitting 10 will not come out of the cavity 31.

A backward pulling force in a direction opposite to the inserting direction ID may act on the inserted female terminal fitting 10, for example, when the wire W is pulled. Such a force tries to withdraw the female terminal fitting 10 while forcibly deforming the lock 40. However, the lock 40 is coupled to at least one adjacent lock 40 by the coupling piece 51. This coupling significantly resists deformation of the lock 40 in a deformation direction DD. Thus, a locking force for locking the female terminal fitting 10 is enhanced. Further, the locks 40 are coupled in a dead space between the side surfaces of the locks 40 and the height of the female housing 30 is unaffected. Accordingly, the locking force of the lock 40 is enhanced while keeping the connector small.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention is applicable to male connectors in which male terminal fittings are inserted into a male connector housing.

The invention was described with respect to cantilevered locks. However, the invention also is applicable to locks having their front supported by a wall of the cavity, i.e. to bridge-type locks having both ends supported.

The invention is furthermore applicable to connectors having locks which are substantially straight and/or do not have any insertion groove (like the insertion groove 49) formed therein.

What is claimed is:

1. A connector with a housing formed with a plurality of cavities for receiving a corresponding plurality of terminal fittings, said cavities being disposed side-by-side such that each said cavity has at least one adjacent cavity, said adjacent cavities being separated from one another by lateral walls, each said lateral wall having a cut away portion for providing communication between the adjacent cavities, a resiliently deformable lock in each of said cavities for locking one of the terminal fittings in the respective cavity, and at least one resiliently deformable coupling piece extending through the cut away portion in the lateral wall and coupling said locks of the adjacent cavities, such that the coupling piece resists deformation of the respective locks and enhances a locking force on the terminal fitting.

2. The connector of claim 1, wherein each said lock has a length and the coupling piece extends over substantially the entire length.

3. The connector of claim 1, wherein a guide groove is provided in each said cavity for allowing a stabilizer of the terminal fitting to be inserted therein, the guide groove being aligned with the coupling piece along an insertion direction of the terminal fitting into the cavity.

4. The connector of claim 1, wherein the lock is slightly narrower than the cavity.

5. The connector of claim 1, wherein the coupling pieces are unitary with the respective locks.

6. The connector of claim 1, wherein at least one of the locks is coupled to the locks of two adjacent cavities by two of the coupling pieces.

7. A connector with a housing formed with a plurality of cavities for receiving a corresponding plurality of terminal fittings, said cavities being disposed side-by-side such that each said cavity has at least one adjacent cavity, a resiliently deformable lock in each of said cavities for locking one of the terminal fittings in the respective cavity, and at least one resiliently deformable coupling piece coupling said locks of the adjacent cavities, wherein the lock has a locking portion for locking the terminal fitting and the coupling piece has a thickness that increases at further distances from the locking portion.

8. The connector of claim 7, wherein at least one cut-away portion is provided in the housing in at least one lateral wall between the adjacent cavities, the coupling piece extending through the cut-away portion of the lateral wall for coupling the locks of the adjacent cavities.

9. A connector with a housing formed with a plurality of cavities for receiving a corresponding plurality of terminal fittings, said cavities being disposed side-by-side such that each said cavity has at least one adjacent cavity, a resiliently deformable lock in each of said cavities for locking one of the terminal fittings in the respective cavity, and at least one resiliently deformable coupling piece coupling said locks of the adjacent cavities, the terminal fittings each comprising a locking projection with which the lock cooperates for locking the terminal fitting in the respective cavity, wherein each lock comprises an insertion groove for allowing insertion of the locking projection.

10. The connector of claim 9, wherein the insertion groove has a bottom with a rear section sloped towards a base end and leading section substantially parallel to an insertion direction of the terminal fitting into the cavity.

11. The connector claim 10, wherein the coupling portion is sloped substantially parallel to the insertion groove.

12. A connector with a housing having opposite front and rear ends and a plurality of cavities extending between the front and rear ends, said cavities being disposed side-by-side such that each said cavity has at least one adjacent cavity, lateral walls separating each said cavity from each of said adjacent cavities, each said lateral wall having a cut-away extending rearwardly from the front end of the housing, a resiliently deformable lock cantilevered forwardly in each said cavity, and at least one resiliently deformable coupling piece coupling said locks of the adjacent cavities, said coupling piece extending through the cut-away of the respective lateral wall.

13. The connector of claim 12, wherein the coupling pieces are unitary with the respective locks.

14. The connector of claim 13, wherein at least one of the locks is coupled to the locks of two adjacent cavities by two of the coupling pieces.

15. The connector of claim 12, wherein each said lock has a length and the coupling piece extends over substantially the entire length.

16. The connector of claim 12, wherein the lock has a locking portion in proximity to the front end of the housing and the coupling piece has a thickness that increases at further distances from the locking portion.

* * * * *